US007101834B2

(12) United States Patent
Gagliardi et al.

(10) Patent No.: US 7,101,834 B2
(45) Date of Patent: Sep. 5, 2006

(54) PROCESS OF TREATING A CARPET WITH A COMPOSITION COMPRISING AN ABSORBENT GELLING MATERIAL

(75) Inventors: Ivano Antonio Gagliardi, Pescara (IT); Luigi Pace, Rome (IT); Antonella Pesce, Pescara (IT); Luca Sacrinelli, Cerveteri (IT); Mélanie Catherine Emmanuelle Fauré-Tromeur, Sévres (FR)

(73) Assignee: The Procter & Gamble Company, Cincinnati, OH (US)

( * ) Notice: Subject to any disclaimer, the term of this patent is extended or adjusted under 35 U.S.C. 154(b) by 90 days.

(21) Appl. No.: 09/939,287

(22) Filed: Aug. 30, 2001

(65) Prior Publication Data

US 2002/0112295 A1 Aug. 22, 2002

(30) Foreign Application Priority Data

Sep. 4, 2000 (EP) ..... 00870187

(51) Int. Cl.
*C11D 3/37* (2006.01)
*C11D 3/08* (2006.01)

(52) U.S. Cl. ..... 510/278; 510/276; 510/315; 510/323; 510/377; 510/445; 510/434; 510/477; 510/507; 510/470; 510/473

(58) Field of Classification Search ..... 510/276, 510/278, 315, 323, 377, 445, 434, 477, 507, 510/470, 473
See application file for complete search history.

(56) References Cited

U.S. PATENT DOCUMENTS

| | | | | | |
|---|---|---|---|---|---|
| 3,901,727 | A | * | 8/1975 | Loudas | 134/4 |
| 4,581,385 | A | * | 4/1986 | Smith et al. | 521/111 |
| 4,648,882 | A | * | 3/1987 | Osberghaus et al. | 8/142 |
| 4,802,997 | A | | 2/1989 | Fox et al. | |
| 4,834,900 | A | * | 5/1989 | Soldanski et al. | 252/88 |
| 5,429,684 | A | * | 7/1995 | Osberghaus et al. | 134/3 |
| 5,534,167 | A | * | 7/1996 | Billman | 510/280 |
| 5,595,731 | A | * | 1/1997 | Vallieres | 424/76.4 |
| 5,683,976 | A | * | 11/1997 | Colurciello, Jr. et al. | 510/278 |
| 5,712,240 | A | * | 1/1998 | Tyerech et al. | 510/424 |
| 5,763,067 | A | * | 6/1998 | Bruggemann et al. | 428/317.9 |
| 5,817,713 | A | * | 10/1998 | Pappas et al. | 524/521 |
| 5,928,384 | A | * | 7/1999 | Scialla et al. | 8/137 |
| 5,955,413 | A | * | 9/1999 | Campagna et al. | 510/278 |
| 6,048,368 | A | * | 4/2000 | Tcheou et al. | 8/137 |
| 6,127,027 | A | * | 10/2000 | Nogami et al. | 427/392 |
| 6,254,892 | B1 | * | 7/2001 | Duccini et al. | 424/497 |
| 6,326,344 | B1 | * | 12/2001 | Levitt | 510/278 |
| 6,391,061 | B1 | * | 5/2002 | Hortel et al. | 8/137.5 |
| 6,403,547 | B1 | * | 6/2002 | Grippaudo et al. | 510/280 |

FOREIGN PATENT DOCUMENTS

| | | | |
|---|---|---|---|
| DE | 0 392 548 A1 | | 10/1990 |
| DE | 44 11 047 A1 | | 10/1995 |
| DE | 199 28 333 C1 | | 11/2000 |
| EP | 392248 | * | 3/1990 |
| JP | 4 185700 | | 7/1992 |

* cited by examiner

*Primary Examiner*—Charles Boyer
(74) *Attorney, Agent, or Firm*—Jeffrey V. Bamber; Mark A. Charles; Kim W. Zerby

(57) ABSTRACT

The present invention relates to a process of treating a fabric with a composition comprising a pre-swollen absorbent gelling material.

12 Claims, No Drawings

PROCESS OF TREATING A CARPET WITH A COMPOSITION COMPRISING AN ABSORBENT GELLING MATERIAL

TECHNICAL FIELD

The present invention relates to a process of treating a fabric, in particular a carpet, with a composition comprising an absorbent gelling material (AGM). More particularly, the present invention relates to a process of treating a fabric with a composition comprising a pre-swollen absorbent gelling material.

BACKGROUND OF THE INVENTION

Carpets produced from synthetic or natural fibers and mixtures thereof are commonly used in residential and commercial applications as a floor covering. Various types of fibers can be used in making carpets such as polyamide fibers, polyester fibers as well as wool, cotton or even silk in the case of rugs.

However, carpets irrespective of whether they are made from natural or synthetic fibers are all prone to soiling and staining. Foods, grease, oils, beverages in particular such as coffee, tea and soft drinks especially those containing acidic dyes can cause unsightly, often dark stains on carpets ("spot stains"). Also fibers may become soiled as a result of dirt particles, clay, dust, i.e., particulate soils in general, which may come into contact with and adhere to the fibers of the carpet. These latter soils often appear in the form of a diffuse layer of soils rather than in the form of spots and tend to accumulate particularly in the so-called "high traffic areas" such as near doors as a result of intensive use of the carpets in such areas.

Compositions for treating and/or cleaning carpets are already known in the art. Indeed, such carpet treatment compositions can be formulated either as solid or liquid compositions. Solid carpet cleaning compositions to be scattered over a soiled carpet are, for example, disclosed in U.S. Pat. No. 4,659,494 or DE-OS-4411047. Furthermore, water can be used to clean carpets. The currently known carpet treaters and/or cleaners as described above, usually show at least some performance on removing particulate soils appearing in the form of a diffuse layer of soils as well as on removing spot stains from carpets.

However, it is well-known from consumer research that the carpet cleaning performance of compositions used to treat carpets may still be further improved. In particular, the removal from the fabric surface, preferably carpet surface, of moist stains and/or moist soil particles as well as stains and/or soil particles dissolved, dispersed or emulsified by any means known, for instance a liquid carpet cleaning composition or water, is not yet satisfactory in order to provide a clean fabric surface and prevent the redeposition after the cleaning of said moist stains and/or moist soil particles as well as stains and/or soil particles dissolved, dispersed or emulsified by any means known onto the fabric surface. Therefore, the removal from the carpet of moist stains and/or moist soil particles as well as stains and/or soil particles dissolved, dispersed or emulsified by any means known may still be further improved.

It is therefore an objective of the present invention to provide a process of treating a carpet with a carpet treatment composition that delivers good overall carpet cleaning performance. In particular, it is an objective of the present invention to provide a process of treating a carpet with a carpet treatment composition that delivers good moist stains and/or moist soil particles removal performance as well as good dissolved, dispersed or emulsified stains and/or soil particles removal performance on various types of stains including proteinic, greasy, bleachable and/or particulate spot stains as well as good soil removal performance, especially for soiling of so-called "high traffic areas".

It has now been found that the above objectives can be met by a process of treating a fabric, and in particular a carpet, with a composition comprising a pre-swollen absorbent gelling material.

An advantage of the process as described herein is that said process provides an effective way of treating a carpet.

A further advantage of the process as described herein is that the pre-swollen absorbent gelling material as used in the process according to the present invention is capable of absorbing malodorous that are present on a fabric, preferably a carpet, and/or liquids spilled over a fabric, preferably a carpet.

Another advantage of the process as described herein, is that said process provides the means to selectively apply a high performance spot stain and soil removal method on heavily stained and/or soiled parts of a fabric, preferably carpet.

Still a further advantage of the present invention is that the process of treating a carpet herein is applicable to all carpet types, especially delicate natural fibers, and are also safe to most of the carpet dye types, even those particularly sensitive natural dyes used therein. The present invention is also suitable to be used to treat upholstery and car seats covering.

SUMMARY OF THE INVENTION

The present invention encompasses a process of treating a fabric with a composition comprising a pre-swollen absorbent gelling material (AGM).

In a preferred embodiment the process according to the present invention is a process of treating a carpet.

In another preferred embodiment the process herein comprises the step of applying said composition onto said fabric, preferably carpet.

In yet another preferred embodiment said composition is a solid composition.

In still another preferred embodiment according to the present invention the composition comprising a pre-swollen absorbent gelling material (AGM) is applied onto said fabric in combination with a second composition.

DETAILED DESCRIPTION OF THE INVENTION

The present invention encompasses a process of treating a fabric with a composition comprising a pre-swollen absorbent gelling material (AGM).

According to the present invention the process herein may be used for the treatment of any kind of fabrics. Preferably, the process according to the present invention is used to treat carpets or hard wearing textiles and fabrics, e.g., upholstery, rugs, curtains. More preferably, the process according to the present invention is used to treat carpets. The process according to the present invention may be used for the removal of stains and soils as well as of odors and/or spilled liquids from fabrics, preferably carpets. In addition the process according to the present invention may be used to hygienise, disinfect and/or exterminate microinsects from fabrics, preferably carpets.

The Composition

The composition used in the process according to the present invention may be in its liquid or solid form.

Preferably, said composition is a solid composition. More preferably, said composition is a solid composition in the form of: a powder composition, preferably a scatterable powder composition; a granular composition; or even in the form of a tablet, preferably of compressed powder and/or granular solid composition. In a highly preferred embodiment according to the present invention, the composition herein is a scatterable powder composition.

In a preferred embodiment according to the present invention, the solid composition herein is substantially moisture-free, preferably moisture-free. Preferably, the further ingredients besides the pre-swollen absorbent gelling material present in said composition, when present, are substantially moisture-free, preferably moisture-free. By "substantially moisture-free" it is meant herein, that the moisture content in a composition or a compound is less than 20%, preferably less than 8%, more preferably less than 5% by weight of said composition or compound. Indeed, by ensuring that said further ingredients, when present, are substantially moisture-free, the swelling, preferably premature swelling, of the pre-swollen absorbent gelling material herein is prevented. By "premature swelling" it is meant herein the swelling of the pre-swollen absorbent gelling material before the treatment of the fabric in a process as described herein, for example upon storage.

By "moisture" it is meant herein, small quantities of liquid, capable of swelling the pre-swollen absorbent gelling material (AGM) herein, as for example water, diffused or condensed in the composition of the present invention.

The moisture content in a given composition can be assessed using the Karl Fisher Titration method as described in Farmacopea Ufficiale, Ed. 9 Vol. I, page 182, or any other method known in the art for the potentiometric titration of water.

In yet another preferred embodiment according to the present invention, the solid composition herein is stored under conditions that substantially prevent or even completely prevent the contact of the composition with any kind of moisture, preferably water. Indeed, a substantially moisture-free composition, when used, will therefore remain substantially moisture-free upon storage, this means between the time of manufacture and usage in a process according to the present invention. Indeed, by ensuring that said composition remains substantially moisture-free the swelling, preferably premature swelling, of the pre-swollen absorbent gelling material herein, and further ingredients, when present, is prevented.

Accordingly, the composition herein may be packaged in a container designed to prevent the premature swelling of the composition, preferably the pre-swollen absorbent gelling material and the further ingredients, when present.

Suitable containers designed to prevent the premature swelling of the composition herein may have a low moisture-vapor permeability rate, preferably a moisture-vapor permeability rate of less than 20 $g/m^2/day$, preferably less than 10 $g/m^2/day$, more preferably less than 1 $g/m^2/day$, even more preferably less than 0.5 $g/m^2/day$, and most preferably less than 0.1 $g/m^2/day$, measured at 23° C. and a relative equilibrium moisture of 85%. Suitable test methods to determine the moisture-vapor permeability rate of a packaging system are for example described in WO 00/23557 or WO 98/40464.

Preferably, the composition is packaged in a re-sealable container or a container that provides a unit dose which is used up at once, as for example a sachet or bag, and the like. Suitable containers are produced from glass, plastics, such as high density polyethylene (HDPE), polypropylene (PP), polyethylene (PE), polyethylene terephthalate (PET) and/or metals. Suitable containers for the composition herein are selected from the group consisting of bottles, bags, pouches sachets, boxes and the like.

In a preferred embodiment, wherein the compositions herein are solid, the compositions may comprise additional materials, which may be used for the contribution to the cleaning process, as flow aids or simply as filler to increase the volume of the composition herein. This additional material may be an "inert material" meaning a material that substantially will not be part of a chemical reaction during storage of the compositions herein and/or during the process as described herein. Any inert material known to those skilled in the art may be used herein. Suitable additional materials herein may be selected from the group consisting of: cellulose, hydrated or anhydrous zeolite, anhydrous inorganic salts, silicates, charcoal, anhydrous organic salts, and the like. The compositions herein may comprise up 95%, preferably from 80% to 5%, more preferably from 70% to 20%, by weight of the total composition of an additional material.

Pre-Swollen Absorbent Gelling Material

As a first essential ingredient, the compositions as used in the process as described herein comprise pre-swollen absorbent gelling material ("AGM").

By "absorbent gelling material" it is meant any water-insoluble and water-swellable material known to those skilled in the art.

By "pre-swollen" it is meant herein, that the absorbent gelling material is in a substantially non-swollen state, preferably in a non-swollen state, and thus capable of further absorbing moisture (i.e., aqueous solvents, such as water, ethanol, etc.). Indeed, the AGM herein have to be capable of at least absorbing some moisture for the present invention as describe herein to work effectively. By a "substantially non-swollen state" it is meant herein, that the aqueous solvent content, preferably water content, of the AGM is less than 20%, preferably less than 15%, more preferably less than 10%, and most preferably less than 5%, by weight of the AGM.

In a preferred embodiment according to the present invention, the aqueous solvent content, preferably water content, of the AGM is less than 10%, preferably less than 5%, more preferably less than 3%, and most preferably less than 1%, by weight of the AGM.

Any absorbent gelling material known to those skilled in the art is suitable to be used in the compositions herein. Suitable absorbent gelling materials may be selected from a variety of water-insoluble, but water-swellable polymers ("absorbent gelling polymers").

Suitable absorbent gelling polymers may be either in powder form or in fibrous form. Suitable absorbent gelling polymers in fibrous form are for example fibrous crosslinked acrylate co-polymers partially neutralized to Na salt or alternating copolymers of maleic anhydride and isobutylene commercially available under the trade-name Fiberdry® from Camelot.

A preferred absorbent gelling material herein is an absorbent gelling polymer. These are typically lightly crosslinked polymers, which contain a multiplicity of acid functional groups such as carboxylic acid groups. Examples of acid polymers suitable for use herein include those which are prepared from polymerizable, acid-containing monomers, or monomers containing functional groups which can be converted to acid groups after polymerization. Thus, such monomers include olefinically unsaturated carboxylic acids and anhydrides, and mixtures thereof. The acid polymers can also comprise polymers that are not prepared from olefinically unsaturated monomers.

Examples of such polymers include polysaccharide-based polymers such as carboxymethyl starch and carboxymethyl cellulose, and poly(amino acid) based polymers such as poly(aspartic acid). For a description of poly(amino acid) absorbent polymers, see, for example, U.S. Pat. No. 5,247,068, issued Sep. 21, 1993 to Donachy et al., which is incorporated herein by reference.

Some non-acid monomers can also be included, usually in minor amounts, in preparing the absorbent polymers herein. Such non-acid monomers can include, for example, monomers containing the following types of functional groups: carboxylate or sulfonate esters, hydroxyl groups, amide-groups, amino groups, nitrile groups, quaternary ammonium salt groups, and aryl groups (e.g., phenyl groups, such as those derived from styrene monomer). Other optional non-acid monomers include unsaturated hydrocarbons such as ethylene, propylene, 1-butene, butadiene, and isoprene. These non-acid monomers are well-known materials and are described in greater detail, for example, in U.S. Pat. No. 4,076,663 (Masuda et al.), issued Feb. 28, 1978, and in U.S. Pat. No. 4,062,817 (Westerman), issued Dec. 13, 1977, both of which are incorporated herein by reference.

Olefinically unsaturated carboxylic acid and anhydride monomers include the acrylic acids typified by acrylic acid itself, methacrylic acid, -chloroacrylic acid, a-cyanoacrylic acid, -methylacrylic acid (crotonic acid), -phenylacrylic acid, -acryloxypropionic acid, sorbic acid, -chlorosorbic acid, angelic acid, cinnamic acid, p-chlorocinnamic acid, -stearylacrylic acid, itaconic acid, citroconic acid, mesaconic acid, glutaconic acid, aconitic acid, maleic acid, fumaric acid, tricarboxyethylene, and maleic anhydride.

Preferred absorbent gelling polymers contain carboxyl groups. These polymers include hydrolyzed starch-acrylonitrile graft copolymers, partially neutralized hydrolyzed starch-acrylonitrile g raft copolymers, starch-acrylic acid graft copolymers, partially neutralized starch-acrylic acid graft copolymers, hydrolyzed vinyl acetate-acrylic ester copolymers, hydrolyzed acrylonitrile or acrylamide copolymers, slightly network crosslinked polymers of any of the foregoing copolymers, polyacrylic acid, and slightly network crosslinked polymers of polyacrylic acid. These polymers can be used either solely or in the form of a mixture of two or more different polymers. Examples of these polymer materials are disclosed in U.S. Pat. No. 3,661,875, U.S. Pat. No. 4,076,663, U.S. Pat. No. 4,093,776, U.S. Pat. No. 4,666,983, and U.S. Pat. No. 4,734,478.

Most preferred polymer materials for use in making the absorbent gelling polymer are slightly network crosslinked polymers partially neutralized polyacrylic acids and starch derivatives thereof.

Most preferably, the absorbent gelling polymer comprise from about 50% to 95%, preferably about 75% neutralized, slightly network crosslinked, polyacrylic acid (i.e., poly (sodium acrylate/acrylic acid)). Network crosslinking renders the polymer substantially water-insoluble and, in part, determines the absorptive capacity and extractable polymer content characteristics of the absorbent polymers. Processes for network crosslinking these polymers and typical network crosslinking agents are described in greater detail in U.S. Pat. No. 4,076,663.

While the absorbent gelling polymer is preferably of one type (i.e., homogeneous), mixtures of absorbent polymers can also be used in the present invention. For example, mixtures of starch-acrylic acid graft copolymers and slightly network crosslinked polymers of polyacrylic acid can be used in the present invention.

For the absorbent gelling polymer as used herein, the particle size and particle size distribution can be determined by conventional sieving or optical methods. In order to enhance the permeability properties of the AGM, it can be advantageous to have more than 10%, preferably more than 20%, more preferably more than 30%, of the particles having a particle size of more than 300 micro-meters. For the purposes of this invention, particle size distributions are determined according to the method described in the Test Methods section of U.S. Pat. No. 5,419,956 (Roe et al).

In a preferred embodiment according to the present invention, the absorbent gelling polymer herein is selected from the group consisting of: cross-linked polycarboxylates and mixtures thereof. Preferably, the absorbent gelling polymer herein is a cross-linked polyacrylate. More preferably, the absorbent gelling polymer herein is a cross-linked polyacrylate wherein the crosslinking agent is Trimettylolpropane triacrylate (TMPTA).

The compositions according to the present invention comprise up to 80%, preferably from 1% to 60%, more preferably from 2% to 50%, even more preferably from 5% to 40%, and most preferably from 5% to 25%, by weight of the total composition of an absorbent gelling material.

Suitable absorbent gelling materials are commercially available under the trade-name Aqualic L74® from Shokubai or XZ-95890.01® from Dow.

Methods for Making Absorbent Gelling Polymers

The absorbent gelling polymers useful in the present invention can be formed by any polymerization and/or crosslinking techniques. Typical processes for producing these polymers are described in U.S. Reissue Pat. No. 32,649 (Brandt et al.), issued Apr. 19, 1988, U.S. Pat. No. 4,666,983 (Tsubakimoto et al.), issued May 19, 1987, and U.S. Pat. No. 4,625,001 (Tsubakimoto et al.), issued Nov. 25, 1986, all of which are incorporated by reference.

Polymerization methods to prepare absorbent gelling polymers useful in the present invention can include free radical, ring-opening, condensation, anionic, cationic, or irradiation techniques. The polymer may be prepared in the neutralized, partially neutralized, or un-neutralized form, even though the desired product is un-neutralized. The absorbent polymer may be prepared using a homogeneous solution polymerization process, or by multi-phase polymerization techniques such as inverse emulsion or suspension polymerization procedures.

Crosslinking can be effected during polymerization by incorporation of suitable crosslinking monomers. Alternatively, the polymers can be crosslinked after polymerization by reaction with a suitable reactive crosslinking agent. Surface crosslinking of the initially formed polymers is a preferred process for obtaining absorbent polymers having relatively high PUP capacity, porosity and permeability. Without being bound by theory, it is believed that surface crosslinking increases the resistance to deformation of the surfaces of swollen absorbent polymer particles, thus reducing the degree of contact between neighboring polymer particles when the swollen particles are deformed under an external pressure. Surface crosslinked absorbent polymers have a higher level of crosslinking in the vicinity of the surface than in the interior. As used herein, "surface" describes the outer-facing boundaries of the particle. For porous absorbent polymers (e.g., porous particles, etc.), exposed internal boundaries can also be included. By a higher level of crosslinking at the surface, it is meant that the level of functional crosslinks for the absorbent polymer in the vicinity of the surface is generally higher than the level of functional crosslinks for the polymer in the interior. The gradation in crosslinking from surface to interior can vary, both in depth and profile.

A number of processes for introducing surface crosslinks are disclosed in the art. Suitable methods for surface crosslinking include those where (i) a di- or poly-functional reagent(s) capable of reacting with existing functional groups within the absorbent polymer is applied to the surface of the absorbent polymer; (ii) a di- or poly-functional reagent that is capable of reacting with other added reagents and possibly existing functional groups within the absorbent polymer such as to increase the level of crosslinking at the surface is applied to the surface (e.g., the addition of monomer plus crosslinker and the initiation of a second polymerization reaction); (iii) no additional poly-functional reagents are added, but additional reaction(s) is induced amongst existing components within the absorbent polymer either during or after the primary polymerization process such as to generate a higher level of crosslinking at or near the surface (e.g., suspension polymerization processes wherein the crosslinker is inherently present at higher levels near the surface); and (iv) other materials are added to the surface such as to induce a higher level of crosslinking or otherwise reduce the surface deformability of the resultant hydrogel. Suitable general methods for carrying out surface crosslinking of absorbent polymers according to the present invention are disclosed in U.S. Pat. No. 4,541,871 (Obayashi), issued Sep. 17, 1985; published PCT application WO92/16565 (Stanley), published Oct. 1, 1992, published PCT application WO 90/08789 (Tai), published Aug. 9, 1990; published PCT application WO 93/05080 (Stanley), published Mar. 18, 1993; U.S. Pat. No. 4,824,901 (Alexander), issued Apr. 25, 1989; U.S. Pat. No. 4,789,861 (Johnson), issued Jan. 17, 1989; U.S. Pat. No. 4,587,308 (Makita), issued May 6, 1986; U.S. Pat. No. 4,734,478 (Tsubakimoto), issued Mar. 29, 1988; U.S. Pat. No. 5,164,459 (Kimura et al.), issued Nov. 17, 1992; published German patent application 4,020,780 (Dahmen), published Aug. 29, 1991; and published European patent application 509,708 (Gartner), published Oct. 21, 1992; all of which are incorporated herein by reference.

Process Steps

Preferably, the process according to the present invention comprises the step of applying the composition herein onto a fabric, preferably a carpet. Depending on its solid or liquid state, said composition may be applied onto the fabric in any way known to those skilled in the art, preferably by spraying, pouring, scattering and the like said composition onto the fabric. In a preferred embodiment wherein said composition is a solid composition, said solid composition is scattered onto the fabric, preferably carpet.

In a preferred embodiment according to the present invention, said process comprises the steps of applying said composition to parts, preferably heavily soiled parts of the fabric, preferably the carpet, e.g., high traffic areas, or spot stains, and optionally mechanically agitating the composition, preferably with an implement, into the soiled parts of the fabric, preferably carpet layer. Any number of implements may be used to provide said mechanical agitation, including brushes, sponges, paper towels, a piece of fabric, a cleaning glove, a human finger and the like. Said mechanical agitation allows the compositions to better penetrate into the fabric, preferably carpet, fibers. In addition, said contact loosens the dirt particles forming the stain.

In another preferred embodiment according to the present invention, said process of treating a fabric, preferably carpet, further comprises the step of at least partially removing said composition, even more preferably, said process of treating a fabric, preferably carpet, further comprises the step of at least partially removing said composition in combination with soil, dirt particles, malodors and/or spilled liquids. Most preferably, the process herein comprises the additional step of leaving the composition to act on the fabric, preferably for 1 to 60 minutes, before the step of at least partially removing said composition, preferably at least partially removing said composition in combination with soil, dirt particles, malodors and/or spilled liquids. The composition and the soil particles, if any, from a carpet may be carried out with the help of any commercially available vacuum cleaner like for instance a standard Hoover® 1300W vacuuming machine.

In a highly preferred embodiment according to the present invention, the composition comprising a pre-swollen absorbent gelling material is used in a process of treating a fabric comprising the steps of applying, in any order, to said fabric said composition comprising a pre-swollen absorbent gelling material and a second composition.

The second composition used in the process according to the highly preferred embodiment of the present invention as described above may be in its liquid or solid form. Indeed, when said second composition is in its liquid form, it may be an aqueous or non-aqueous liquid composition; a thickened or non-thickened liquid composition; a sprayable liquid composition; a foaming or non-foaming liquid composition and/or a pasteous composition. In the case, that said second composition is in its solid form, it may be in the form of: a powder composition, preferably a scatterable powder composition; a granular composition; or even in the form of a tablet, preferably of compressed powder and/or granular solid composition.

Preferably, said second composition is in its liquid form, more preferably it is: an aqueous or non-aqueous liquid composition; a thickened or non-thickened liquid composition; a sprayable liquid composition; a foaming or non-foaming liquid composition and/or a pasteous composition. Most preferably, said second composition is an aqueous or non-aqueous liquid sprayable composition.

Depending on its solid or liquid state, the second composition may be applied onto the fabric in any way known to those skilled in the art, preferably by spraying, pouring, scattering and the like said second composition onto the fabric.

In a preferred embodiment according to the present invention, said second composition is a liquid or solid cleaning composition or comprises ingredients selected from the group consisting of: water; and polar solvents (like ethanol, methanol, acetone, etc.); and mixtures thereof. Preferably, said second composition is a carpet cleaning composition or comprises ingredients selected from the group consisting of: water; and polar solvents (like ethanol, methanol, acetone, etc.); and mixtures thereof. More preferably, said second composition is a conventional liquid carpet cleaning composition or water. Suitable liquid carpet cleaning compositions may be sprayable, foaming or non-foaming liquid carpet treatment compositions dispensed using a manually- or electrically-operated spraying device or a pressurized spraying device (aerosol can, pressurizer or carbonater). It is in this preferred embodiment wherein the additional advantage of providing the means to selectively apply a high performance spot stain and soil removal method on heavily stained and/or soiled parts of a fabric, preferably carpet, and apply a normal performing spot stain and soil removal method on normally stained and/or soiled parts of a fabric, preferably carpet is especially noteworthy.

By "conventional liquid or solid carpet treatment/cleaning composition" it is meant herein, any carpet treatment/cleaning composition suitable for the treatment/cleaning of carpets. Preferably, said carpet treatment/cleaning composition may comprise at least one ingredient selected from the group consisting of surfactants, builders, enzymes, solvents and bleaches. Suitable conventional liquid or solid carpet treatment composition are, for example, commercially available as Resolve liquid®, 1001 liquid®, Resolve powder® and Capture powder®.

In another embodiment according to the present invention, further compositions, liquid or solid, may be applied onto said fabric before, during or after the step of applying said composition comprising a pre-swollen absorbent gelling material and a second composition onto the fabric.

In a highly preferred embodiment according to the present invention, said composition comprising a pre-swollen absorbent gelling material is a scatterable solid powder composition and said second composition is a conventional liquid carpet treatment composition or water.

The Applicant has now surprisingly found that a composition comprising a pre-swollen absorbent gelling material used in a process according to the present invention is capable of providing an effective means of trapping, this means locking in, moist stains and/or moist soil particles found on a fabric, preferably a carpet, as well as stains and/or soil particles dissolved, dispersed or emulsified by any means known, for instance a liquid cleaning composition or water. Indeed, said moist stains and/or moist soil particles as well as stains and/or soil particles dissolved, dispersed or emulsified by any means known found on a fabric, preferably a carpet, are absorbed, when such a composition is applied onto said fabric, preferably carpet. Furthermore, malodors present on a fabric, preferably a carpet, and/or liquids spilled over on a fabric, preferably a carpet, are absorbed by the AGM. The absorbency of any moisture-containing stains and/or soil particles is due to the swelling properties of the pre-swollen absorbent gelling material herein. In a preferred embodiment herein wherein the composition is removed from the fabric, preferably carpet, after its application onto the fabric, the removal of moist stains and/or moist soil particles found on a fabric, preferably a carpet, as well as stains and/or soil particles dissolved, dispersed or emulsified by any means known, for instance a liquid cleaning composition or water, is facilitated as they are absorbed in the swollen absorbent gelling material, which can be more easily removed from the fabric surface, preferably carpet surface, by any means known to those skilled in the art (e.g., vacuum cleaning of said carpet), as compared to the removal of the same moist stains and/or moist soil particles as well as stains and/or soil particles dissolved, dispersed or emulsified by any means known in a non-absorbed state. Furthermore, the above described absorbency prevents the redeposition onto the fabric surface of moisture-containing stains and/or soil particles.

It has now been found that any kinds of moisture-containing stains and/or soil particles, such as moisture-containing particulate stains, greasy/oily stains, proteinic stains, etc., can be absorbed by the absorbent gelling material. Such moisture-containing stains and/or soil particles can either be found in so-called soiled high traffic areas or spot stains.

By "high traffic areas" it is meant herein, areas with an intensive use of the carpets in such areas as for example near doors.

By "particulate stains" it is meant herein, any soils or stains of particulate nature that can be found on any carpet, e.g. clay, dirt, dust, mud, concrete and the like.

By "greasy/oily stains" it is meant herein, any soils or stains of greasy/oily nature that can be found on any carpet, e.g., make-up, lipstick, dirty motor oil and mineral oil, greasy food like mayonnaise, spaghetti sauce and shoe polish.

By "proteinic stains" it is meant herein, any soils or stains of proteinic nature that can be found on any carpet, e.g., grass, urine and blood stains.

The soil/stains removal performance of a given composition on a soiled carpet may be evaluated by the following test method: The composition according to the present invention is applied onto the portion of a carpet comprising a moist stain and/or moist soil particles and/or a dissolved, dispersed or emulsified stain and/or dissolved, dispersed or emulsified soil particles; left to act thereon from 1 to 60 minutes, preferably 20 minutes; after which the carpet is vacuum cleaned using any commercially available vacuum cleaners like for instance a standard Hoover® 1300W vacuuming machine. The soils used in this test may be particulate stains, greasy/oily stains or enzymatic stain as described herein. The cleaning performance may be evaluated by visual using panel score units to rate the cleaning performance. The visual grading may be performed by a group of expert panelists using panel score units (PSU). To asses the soil/stains removal performance benefits of a given composition a PSU-scale ranging from 0, meaning no noticeable difference in cleanliness of a treated, initially soiled, carpet versus an untreated, similarly soiled, carpet, to 4, meaning a clearly noticeable difference in cleanliness of a treated, initially soiled, carpet versus an untreated, similarly soiled, carpet, can be applied.

Alternatively, the cleaning performance of a composition on a soiled carpet may be evaluated by the measurement of the delta L with a miniscan, for example a calorimeter CR310® commercially available from Minolta. Delta L represents the difference of gray intensity between a reference (soiled carpet tile) and a carpet tile treated with the composition to be assessed, this means with the composition as described herein. The difference in cleaning performance between different compositions may be assessed by comparing the delta Ls that have been measured for said composition. In practice, the miniscan takes a photo of the carpet tile and quantitatively analysis its gray intensity (L is the quantitative value, ranging from 100% for a pure white to 0% for a pure black). The higher the delta L , wherein delta L=L(sample)−L(reference), the better is the cleaning performance of a sample (composition).

The present invention further encompasses a kit comprising (a) a composition comprising a pre-swollen absorbent gelling material as described herein and (b) a cleaning composition or water, preferably a carpet cleaning composition or water, more preferably a conventional carpet cleaning composition or water. Preferably, the composition comprising a pre-swollen absorbent gelling material and/or said conventional carpet cleaning composition may comprise optional ingredients as described in the present application.

Furthermore, the present invention encompasses a kit comprising (a) a composition comprising a pre-swollen absorbent gelling material as described herein and (b) a set of instructions to use said composition in a process wherein the composition is applied onto a fabric, preferably a carpet. Preferably, said set of instructions specifies that the composition is applied in combination with a second composition, preferably a carpet cleaning composition more preferably a conventional carpet cleaning composition, or water. More preferably, said set of instructions specifies that the process comprises the steps of applying, in any order given, to said fabric, preferably carpet, said composition comprising a pre-swollen absorbent gelling material and a second composition, preferably a carpet cleaning composition more preferably a conventional carpet cleaning composition, or water. Most preferably, said set of instructions specifies that the process comprises steps as described in the section titled "Process steps" of the present application.

Furthermore, the present invention encompasses the use of a pre-swollen absorbent gelling material for the manufacture of a composition for use in the process according to the present invention.

Activated Zeolite

As a highly preferred although optional ingredient, the composition herein may additionally comprise an activated zeolite.

By "zeolite" it is meant herein, a naturally occurring aluminosilicate mineral with three-dimensional structure based on $[SiO_4]^{4-}$ and $[AlO_4]^{4-}$ polyhedra. The polyhedra are linked by their corners to produce an open structural form providing internal cavities. Without being bound by theory, the Applicant found that in these internal cavities molecules of various sizes can be trapped. The molecular trapping depends on the size and polar properties of the zeolite and the molecules to be trapped. Zeolites generally act as adsorbent of molecules, which are small enough to pass into their internal cavities by physical ("physisorption") and/or chemical ("chemisorption") bonding. One type of molecules to be absorbed by the zeolites herein may be water or polar solvents such as ethanol.

By "activated zeolite" it is meant herein, a substantially anhydrous zeolite, preferably an anhydrous zeolite. By "substantially anhydrous zeolite" it is meant herein, that the water content in the zeolite is less than 12%, preferably less than 8%, more preferably less than 5% by weight.

The activated zeolite herein is rendered anhydrous by any means known to those skilled in the art to render material, preferably zeolites, anhydrous. A suitable means of rendering zeolite anhydrous is to heat zeolite in a furnace at high temperature for a suitable amount of time, preferably followed by cooling in the presence of a desiccant or by other processes such as freeze drying etc. For example, the zeolite may be heated at a temperature of from 200° C. to 500° C., preferably 400° C. or above for a period of at least 24 hours, preferably 48 hours. A suitable desiccant may be phosphorous pentoxide. Furthermore, suitable activated zeolites can be produced by calcination.

Suitable activated zeolites are commercially available from UOP under the tradename Molecular Sieve UOP®.

The composition herein preferably comprises up to 50%, preferably from 5% to 50%, more preferably from 10% to 40%, even more preferably from 15% to 40%, and most preferably from 20% to 40%, by weight of the total composition of an activated zeolite.

The presence of an activated zeolite in preferred compositions employed in the process of treating a fabric according to the present invention contributes to the excellent cleaning and sanitizing performance on various types of stains and soils of the compositions of the present invention as described in the Applicant's co-pending European Patent Application 00870134.4 (case CM 2381 on the attorney's docket), incorporated herein by reference.

Solvent

As a highly preferred although optional ingredient, the composition comprising a pre-swollen absorbent gelling material may further comprise a solvent. The solvent is preferably loaded onto the activated zeolite, when present, this means, sprayed onto the activated zeolite described herein and adsorbed onto the outer surface of the activated zeolite itself.

Typically, the compositions herein may comprise up to 90%, preferably from 0.1% to 20%, more preferably from 0.5% to 10% and most preferably from 3% to 10% by weight of the total composition of a solvent or a mixture thereof.

Suitable solvents for use herein include aliphatic and/or aromatic alcohol, glycol ethers and/or derivatives thereof, polyol and mixtures thereof.

Suitable aromatic alcohols to be used herein are according to the formula $R_1$—OH wherein $R_1$ is an alkyl substituted or non-alkyl substituted aryl group of from 1 to 20 carbon atoms, preferably from 2 to 15 and more preferably from 2 to 10. A suitable aromatic alcohol to be used herein is benzyl alcohol.

Suitable aliphatic alcohols to be used herein are according to the formula $R_2$—OH wherein $R_2$ is a linear or branched saturated or unsaturated hydrocarbon chain of from 1 to 20 carbon atoms, preferably from 1 to 10 and more preferably from 2 to 6. Highly preferred herein are aliphatic alcohols with 2 to 4 carbon atoms and most preferably 4 carbon atoms, or mixtures thereof. Suitable aliphatic alcohols to be used herein include linear alcohol like 2-octanol, decanol, isopropyl alcohol, propyl alcohol, ethanol and/or methanol. Highly preferred herein are ethanol, isopropyl alcohol or a mixture thereof.

Ethanol may be commercially available from Eridania Italia under its chemical name.

Isopropanol may be commercially available from Merck/BDH Italia under its chemical name.

Suitable glycol ethers and/or derivatives thereof to be used herein include monoglycol ethers and/or derivatives thereof, polyglycol ethers and/or derivatives thereof and mixtures thereof.

Suitable monoglycol ethers and derivatives thereof to be used herein include n-buthoxypropanol (n-BP), CELLOSOLVE® solvents or mixtures thereof. Preferred Cellosolve® solvents include propoxy ethyl acetate salt (i.e., Propyl Cellosolve acetate salt®), ethanol-2-butoxy phosphate salt (i.e., Butyl Cellosolve phosphate salt®), 2-(Hexyloxy) ethanol (i.e., 2-hexyl Cellosolve®), 2-ethoxy ethanol (i.e., 2-ethyl Cellosolve®), 2-butoxyethanol (i.e., 2-buthyl Cellosolve®) or mixtures thereof.

Suitable polyglycol ethers and derivatives thereof to be used herein include n-butoxypropoxypropanol (n-BPP), butyl triglycol ether (BTGE), butyl diglycol ether (BDGE), CARBITOL® solvents or mixtures thereof.

Preferred CARBITOL® solvents are compounds of the 2-(2-alkoxyethoxy) ethanol class, 2-(2-alkoxyethoxy) propanol class and/or 2-(2-alkoxyethoxy) butanol class wherein the alkoxy group is derived from ethyl, propyl or butyl. A preferred carbitol is 2-(2-butoxyethoxy) ethanol also known as butyl carbitol®.

Preferred glycol ethers and/or derivatives thereof are 2-ethoxyethanol, 2-butoxyethanol, n-butoxypropoxypropanol, butyl carbitol® or mixtures thereof.

Suitable polyol solvents to be used herein are the polyols having at least 2 hydroxyl groups (—OH) like diols. Suitable diols to be used herein include 2-ethyl-1,3-hexanediol, 2,2,4-trimethyl-1,3-pentanediol, methyl-2,4 pentanediol or mixture thereof.

Other suitable solvent may be selected from the group consisting of: terpenes such as pinene, limonene and geraniol; ketones such as dipropyl ketone, butyrolactone and acetophenone; aromatic solvents such as toluene and xylene; and halogenated solvents such as bromopropane and chlorobenzene; and mixtures thereof.

Preferably, the composition comprising a pre-swollen absorbent gelling material may comprise a solvent selected from the group consisting of aliphatic and/or aromatic alcohol, glycol ethers and derivatives thereof, and polyols and mixtures thereof.

In a preferred embodiment herein, wherein the composition comprising a pre-swollen absorbent gelling material is a solid composition, said composition may comprise a solvent selected from the group consisting of aliphatic and/or aromatic alcohol, glycol ethers and derivatives thereof, and polyols and mixtures thereof. More preferably, a solvent selected from the group consisting of glycol ethers.

The solvents, when present, contribute to the excellent overall cleaning performance of the present invention. Additionally, their addition in the compositions herein also enhances the sanitizing properties of the compositions.

Optional Ingredients

The composition comprising a pre-swollen absorbent gelling material herein and the second composition as described herein above, when present, may comprise optional ingredients in addition to the pre-swollen absorbent gelling material or ingredients present in the second composition, when present. When including optional ingredients in said compositions the compatibility of said optional ingredients with the essential ingredients of the composition (s) have to be taken into account. Indeed, for instance optional ingredients that swell the pre-swollen absorbent gelling material are not suitable to be included in the composition comprising a pre-swollen absorbent gelling material.

Peroxygen Bleach

As an optional but highly preferred ingredient the compositions according to the present invention may comprise a peroxygen bleach.

Suitable peroxygen bleaches to be used herein are selected from the group consisting of: hydrogen peroxide; water soluble sources of hydrogen peroxide; organic or inorganic peracids; hydroperoxides; diacyl peroxides; and mixtures thereof.

As used herein a hydrogen peroxide source refers to any compound that produces perhydroxyl ions when said compound is in contact with water. Suitable water-soluble sources of hydrogen peroxide for use herein are selected from the group consisting of percarbonates, perborates and persilicates and mixtures thereof.

Suitable diacyl peroxides for use herein are selected from the group consisting of aliphatic, aromatic and aliphatic-aromatic diacyl peroxides, and mixtures thereof.

Suitable aliphatic diacyl peroxides for use herein are dilauroyl peroxide, didecanoyl peroxide, dimyristoyl peroxide, or mixtures thereof. A suitable aromatic diacyl peroxide for use herein is for example benzoyl peroxide. A suitable aliphatic-aromatic diacyl peroxide for use herein is for example lauroyl benzoyl peroxide. Such diacyl peroxides have the advantage to be particularly safe to carpets and carpet dyes while delivering excellent bleaching performance.

Suitable organic or inorganic peracids for use herein are selected from the group consisting of: persulphates such as monopersulfate; peroxyacids such as diperoxydodecandioic acid (DPDA) and phthaloyl amino peroxycaproic acid (PAP); magnesium perphthalic acid; perlauric acid; perbenzoic and alkylperbenzoic acids; and mixtures thereof.

Suitable hydroperoxides for use herein are selected from the group consisting of tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide and mixtures thereof. Such hydroperoxides have the advantage to be particularly safe to carpets and carpet dyes while delivering excellent bleaching performance.

Preferred peroxygen bleaches herein are selected from the group consisting of hydrogen peroxide; water soluble sources of hydrogen peroxide; organic or inorganic peracids; hydroperoxides; and diacyl peroxides; and mixtures thereof. More preferred peroxygen bleaches herein are selected from the group consisting of hydrogen peroxide, water soluble sources of hydrogen peroxide and diacyl peroxides and mixtures thereof. Even more preferred peroxygen bleaches herein are selected from the group consisting of hydrogen peroxide, water soluble sources of hydrogen peroxide, aliphatic diacyl peroxides, aromatic diacyl peroxides and aliphatic-aromatic diacyl peroxides and mixtures thereof. Most preferred peroxygen bleaches herein are hydrogen peroxide, water soluble sources of hydrogen peroxide or mixtures thereof.

Typically, the liquid compositions herein comprise from 0.01% to 20%, preferably from 0.5% to 10%, and more preferably from 1% to 7% by weight of the total composition of a peroxygen bleach, or mixtures thereof.

The presence of a peroxygen bleach in preferred compositions employed in the process of treating a fabric according to the present invention contributes to the excellent cleaning and sanitizing performance on various types of soils including on spot stains like bleachable stains (e.g., coffee, beverage, food) of the compositions of the present invention.

By "bleachable stains" it is meant herein any soils or stains containing ingredients sensitive to bleach that can be found on any carpet, e.g., coffee or tea.

Surfactants

As an optional but highly preferred ingredient the compositions according to the present invention may comprise a surfactant or a mixture thereof.

Typically, the compositions herein may comprise up to 50%, preferably from 0.1% to 20%, more preferably from 0.5% to 10% and most preferably from 1% to 5% by weight of the total composition of a surfactant.

Such surfactants may be selected from those well-known in the art including anionic, nonionic, zwitterionic, amphoteric and cationic surfactants and mixtures thereof.

Particularly suitable surfactants to be used herein are anionic surfactants. Said anionic surfactants are preferred herein as they further contribute to the outstanding stain removal performance of the compositions of the present invention on various types of stains. Moreover they do not stick on carpet, thereby reducing resoiling.

Suitable anionic surfactants include sulfosuccinate surfactants, sulfosuccinamate surfactants, sulfosuccinamide surfactants, alkyl carboxylate surfactants, sarcosinate surfactants, alkyl sulfate surfactants, alkyl sulphonate surfactants, alkyl glycerol sulfate surfactants, alkyl glycerol sulphonate surfactants and mixtures thereof.

Suitable sulfosuccinate surfactants are according to the formula

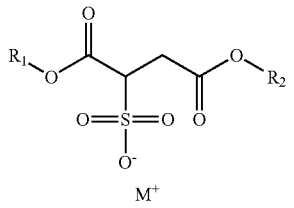

wherein: $R_1$ is hydrogen or a hydrocarbon group selected from the group consisting of straight or branched alkyl radicals containing from 6 to 20 carbon atoms, preferably 8 to 18 carbon atoms, more preferably 10 to 16 carbon atoms, and alkyl phenyl radicals containing from 6 to 18 carbon atoms in the alkyl group; $R_2$ is a hydrocarbon group selected from the group consisting of straight or branched alkyl radicals containing from 6 to 20 carbon atoms, preferably 8 to 18 carbon atoms, more preferably 10 to 16 carbon atoms, and alkyl phenyl radicals containing from 6 to 18 carbon atoms in the alkyl group; and M is hydrogen or a cationic moiety, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Such sulfosuccinate surfactants are commercially available under the tradenames Aerosol® from Cytec, Anionyx® from Stepan, Arylene® from Hart, Setacin® from Zschimmer & Schwarz, Mackanate® from Mcintyre and Monawet® from Mona Industries.

Suitable alkyl sulphonate surfactants for use herein include water-soluble salts or acids of the formula $RSO_3M$ wherein R is a $C_6$–$C_{20}$ linear or branched, saturated or unsaturated alkyl group, preferably a $C_8$–$C_{18}$ alkyl group and more preferably a $C_{10}$–$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

An example of a $C_{14}$–$C_{16}$ alkyl sulphonate is Hostapur® SAS available from Hoechst.

Suitable alkyl sulphate surfactants for use herein are according to the formula $R_1SO_4M$ wherein $R_1$ represents a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

By "linear alkyl sulphate or sulphonate" it is meant herein a non-substituted alkyl sulphate or sulphonate wherein the alkyl chain comprises from 6 to 20 carbon atoms, preferably from 8 to 18 carbon atoms, and more preferably from 10 to 16 carbon atoms, and wherein this alkyl chain is sulphated or sulphonated at one terminus.

By "branched sulphonate or sulphate", it is meant herein an alkyl chain having from 6 to 20 total carbon atoms, preferably from 8 to 18 total carbon atoms, and more preferably from 10 to 16 total carbon atoms, wherein the main alkyl chain is substituted by at least another alkyl chain, and wherein the alkyl chain is sulphated or sulphonated at one terminus.

Particularly preferred branched alkyl sulphates to be used herein are those containing from 10 to 14 total carbon atoms like Isalchem 123 AS®. Isalchem 123 AS® commercially available from Enichem is a $C_{12\text{-}13}$ surfactant which is 94% branched. This material can be described as $CH_3$—$(CH_2)_m$—$CH(CH_2OSO_3Na)$—$(CH_2)_n$—$CH_3$ where n+m=8–9. Also preferred alkyl sulphates are the alkyl sulphates where the alkyl chain comprises a total of 12 carbon atoms, i.e., sodium 2-butyl octyl sulphate. Such alkyl sulphate is commercially available from Condea under the trade name Isofol® 12S. Particularly suitable liner alkyl sulphonates include C12–C16 paraffin sulphonate like Hostapur® SAS commercially available from Hoechst.

Suitable sulfosuccinamate surfactants for use herein are according to the formula

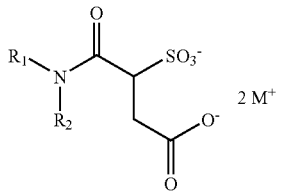

wherein $R_1$ and $R_2$ each independently represent a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable sulfosuccinamide surfactants for use herein are according to the formula

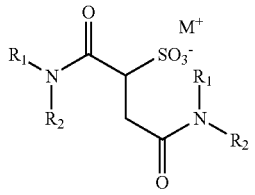

wherein $R_1$ and $R_2$ each independently represent a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable alkyl carboxylate surfactants for use herein are according to the formula $RCO_2M$ wherein: R represents a hydrocarbon group selected from the group consisting of straight or branched alkyl radicals containing from 6 to 20, preferably 8 to 18, more preferably 10 to 16, carbon atoms and alkyl phenyl radicals containing from 6 to 18 carbon atoms in the alkyl group. M is H or a cation, e.g., an alkali metal cation (e.g., sodium, potassium, lithium, calcium, magnesium and the like) or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Suitable sarcosinate surfactants to be used herein include acyl sarcosinate or mixtures thereof, in its acid and/or salt form, preferably long chain acyl sarcosinates having the following formula:

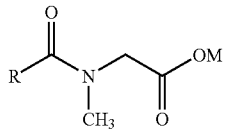

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, particularly preferred long chain acyl sarcosinates to be used herein include $C_{12}$ acyl sarcosinate, i.e., an acyl sarcosinate according to the above formula wherein M is hydrogen and R is an alkyl group of 11 carbon atom, sodium N-lauroyl sarcosinate, i.e., an acyl sarcosinate according to the above formula wherein M is sodium and R is an alkyl group of 11 carbon atom, and $C_{14}$ acyl sarcosinate (i.e., an acyl sarcosinate according to the above formula wherein M is hydrogen and R is an alkyl group of 13 carbon atoms). Sodium N-lauroyl sarcosinate is commercially available, for example, as Hamposyl L-30® supplied by Hampshire or Crodasinic LS30® supplied by Croda. $C_{14}$ acyl sarcosinate is commercially available, for example, as Hamposyl M-30® supplied by Hampshire or Crodasinic MS30® supplied by Croda.

Suitable nonionic surfactants include amine oxide surfactants. Suitable amine oxide surfactants are according to the formula $R_1R_2R_3NO$, wherein each of $R_1$, $R_2$ and $R_3$ is independently a saturated substituted or unsubstituted, linear or branched alkyl groups of from 1 to 30 carbon atoms, preferably of from 1 to 20 carbon atoms, and mixtures thereof.

Particularly preferred amine oxide surfactants to be used according to the present invention are amine oxide surfactants having the following formula $R_1R_2R_3NO$ wherein $R_1$ is a saturated linear or branched alkyl group of from 1 to 30 carbon atoms, preferably of from 6 to 20 carbon atoms, more preferably of from 6 to 16 carbon atoms, and wherein $R_2$ and $R_3$ are independently substituted or unsubstituted, linear or branched alkyl groups of from 1 to 4 carbon atoms, preferably of from 1 to 3 carbon atoms, and more preferably are methyl groups. Preferred amine oxide surfactants used herein are pure-cut amine oxide surfactants, i.e., a pure single amine oxide surfactant, e.g. $C_8$ N,N-dimethyl amine oxide, as opposed to mixtures of amine oxide surfactants of different chain lengths Suitable amine oxide surfactants for use herein are for instance pure cut $C_8$ amine oxide, pure cut $C_{10}$ amine oxide, pure cut $C_{14}$ amine oxide, natural blend $C_8$–$C_{10}$ amine oxides as well as natural blend $C_{12}$–$C_{16}$ amine oxides. Such amine oxide surfactants may be commercially available from Hoechst or Stephan.

Suitable nonionic surfactants for use herein also include any ethoxylated $C_6$–$C_{24}$ fatty alcohol nonionic surfactant, alkyl propoxylates and mixtures thereof, fatty acid $C_6$–$C_{24}$ alkanolamides, $C_6$–$C_{20}$ polyethylglycol ethers, polyethylene glycol with molecular weight 1000 to 80000 and glucose amides, alkyl pyrrolidones.

Suitable cationic surfactants for use herein include quaternary ammonium compounds of the formula $R_1R_2R_3R_4N+$ where $R_1$,$R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Suitable zwitterionic surfactants are zwitterionic betaine surfactants. Suitable zwitterionic betaine surfactants for use herein contain both a cationic hydrophilic group, i.e., a quaternary ammonium group, and anionic hydrophilic group on the same molecule at a relatively wide range of pHs. The typical anionic hydrophilic groups are carboxylates and sulphonates, although other groups like sulfates, phosphonates, and the like can be used. A generic formula for the zwitterionic betaine surfactant to be used herein is:

$$R_1—N+(R_2)(R_3)R_4X—$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ sulphonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group, which is a carboxylate or sulphonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24, preferably from 8 to 18, and more preferably from 10 to 16 carbon atoms. These simple alkyl groups are preferred for cost and stability reasons. However, the hydrophobic group $R_1$ can also be an amido radical of the formula $R_a$—C(O)—NH—$(C(R_b)_2)m$, wherein $R_a$ is an aliphatic or aromatic, saturated or unsaturated, substituted or unsubstituted hydrocarbon chain, preferably an alkyl group containing from 8 up to 20, preferably up to 18, more preferably up to 16 carbon atoms, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred R3 is $C_1$–$C_4$ sulphonate group, or a $C_1$–$C_3$ alkyl and more preferably methyl. Preferred $R_4$ is $(CH_2)_n$ wherein n is an integer from 1 to 10, preferably from 1 to 6, more preferably from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N, N-dimethylammonia)acetate, 2-(N-coco N, N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or $C_{10}$–$C_{14}$ fatty acylamidopropylene(hydropropylene) sulfobetaine. For example $C_{10}$–$C_{14}$ fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Miratainе H2C-HA®.

A preferred surfactant for use herein is an anionic surfactant or a zwitterionic surfactant or a mixture thereof, a more preferred surfactant is a sulfosuccinate surfactant, sulfosuccinamate surfactant, sulfosuccinamide surfactant, carboxylate surfactant, sarcosinate surfactant, alkyl sulfate surfactant, alkyl sulphonate surfactant, alkyl glycerol sulfate surfactant, alkyl glycerol sulphonate surfactant or a zwitterionic betaine surfactant and mixtures thereof.

In a preferred embodiment a preferred surfactant for use herein is a sarcosinate surfactant, an alkyl sulphonate surfactant, an alkyl sulphate surfactant, or a zwitterionic betaine surfactant and mixtures thereof, and the most preferred surfactant herein is an alkyl sarcosinate surfactant.

In another preferred a preferred surfactant for use herein is a mixture of a sulfosuccinate surfactant and a second anionic surfactant. More preferably, said surfactant is a mixture of a sulfosuccinate surfactant and a sulphate surfactant. Most preferably, said surfactant is a sulfosuccinate surfactant.

The presence of a surfactant in preferred compositions when employed in the process of treating a fabric according to the present invention contributes to the excellent cleaning performance on various types of soils including diffuse soils (e.g., particulate and/or greasy soils) that tend to accumulate in the so-called "high traffic areas" but also in delivering good cleaning performance on other types of stains or soils, i.e., proteinic stains like blood.

Solvents

The second composition according to the present invention, when present, may comprise a solvent or a mixture thereof.

Typically, the compositions herein may comprise up to 90%, preferably from 0.1% to 20%, more preferably from 0.5% to 10% and most preferably from 1% to 5% by weight of the total composition of a solvent or a mixture thereof.

Suitable solvents for use herein include aliphatic and/or aromatic alcohol, glycol ethers and/or derivatives thereof, polyol and mixtures thereof.

Suitable aromatic alcohols to be used herein are according to the formula $R_1$—OH wherein $R_1$ is an alkyl substituted or non-alkyl substituted aryl group of from 1 to 20 carbon atoms, preferably from 2 to 15 and more preferably from 2 to 10. A suitable aromatic alcohol to be used herein is benzyl alcohol.

Suitable aliphatic alcohols to be used herein are according to the formula $R_2$—OH wherein $R_2$ is a linear or branched saturated or unsaturated hydrocarbon chain of from 1 to 20 carbon atoms, preferably from 1 to 10 and more preferably from 2 to 6. Highly preferred herein are aliphatic alcohols with 2 to 4 carbon atoms and most preferably 4 carbon atoms, or mixtures thereof. Suitable aliphatic alcohols to be used herein include linear alcohol like 2-octanol, decanol, isopropyl alcohol, propyl alcohol, ethanol and/or methanol. Highly preferred herein are ethanol, isopropyl alcohol or a mixture thereof.

Ethanol may be commercially available from Eridania Italia under its chemical name.

Isopropanol may be commercially available from Merck/BDH Italia under its chemical name.

Suitable glycol ethers and/or derivatives thereof to be used herein include monoglycol ethers and/or derivatives thereof, polyglycol ethers and/or derivatives thereof and mixtures thereof.

Suitable monoglycol ethers and derivatives thereof to be used herein include n-buthoxypropanol (n-BP), CELLOSOLVE® solvents or mixtures thereof. Preferred Cellosolve® solvents include propoxy ethyl acetate salt (i.e., Propyl Cellosolve acetate salt®), ethanol-2-butoxy phosphate salt (i.e., Butyl Cellosolve phosphate salt®), 2-(Hexyloxy)ethanol (i.e., 2-hexyl Cellosolve®), 2-ethoxy ethanol (i.e., 2-ethyl Cellosolve®), 2-butoxyethanol (i.e., 2-buthyl Cellosolve®) or mixtures thereof.

Suitable polyglycol ethers and derivatives thereof to be used herein include n-butoxypropoxypropanol (n-BPP), butyl triglycol ether (BTGE), butyl diglycol ether (BDGE), CARBITOL® solvents or mixtures thereof.

Preferred CARBITOL® solvents are compounds of the 2-(2-alkoxyethoxy)ethanol class, 2-(2-alkoxyethoxy) propanol class and/or 2-(2-alkoxyethoxy)butanol class wherein the alkoxy group is derived from ethyl, propyl or butyl. A preferred carbitol is 2-(2-butoxyethoxy)ethanol also known as butyl carbitol®.

Preferred glycol ethers and/or derivatives thereof are 2-ethoxyethanol, 2-butoxyethanol, n-butoxypropoxypropanol, butyl carbitol® or mixtures thereof.

Suitable polyol solvents to be used herein are the polyols having at least 2 hydroxyl groups (—OH) like diols. Suitable diols to be used herein include 2-ethyl-1,3-hexanediol, 2,2,4-trimethyl-1,3-pentanediol, methyl-2,4 pentanediol or mixture thereof.

Other suitable solvent may be selected from the group consisting of: terpenes such as pinene, limonene and geraniol; ketones such as dipropyl ketone, butyrolactone and acetophenone; aromatic solvents such as toluene and xylene; and halogenated solvents such as bromopropane and chlorobenzene; and mixtures thereof.

The solvents, when present, further contribute to the excellent overall cleaning performance of the present invention. Additionally, their addition in the compositions herein also enhances the sanitising properties of the compositions.

Stabilizing Agents

The compositions of the present invention may further comprise a stabilizing agent selected from the group consisting of hydroxy pyridine N-oxides or derivatives thereof and mixtures thereof.

Suitable hydroxy pyridine N-oxides or derivatives thereof are according to the following formula:

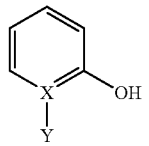

wherein X is nitrogen, Y is one of the following groups oxygen, —CHO, —OH, —$(CH_2)_n$—COOH, wherein n is an integer of from 0 to 20, preferably of from 0 to 10 and more preferably is 0, and wherein Y is preferably oxygen. Accordingly particularly preferred hydroxy pyridine N-oxides or derivatives thereof to be used herein is 2-hydroxy pyridine N-oxide.

Hydroxy pyridine N-oxides or derivatives thereof may be commercially available from Sigma.

Typically, the compositions herein may comprise up to 2%, preferably from 0.001% to 1% and more preferably from 0.001% to 0.5% by weight of the total composition of a hydroxy pyridine N-oxide or derivatives thereof or mixtures thereof.

Chelating Agents

The compositions of the present invention may further comprise a chelating agent.

Suitable chelating agents are those known to those skilled in the art. Particularly suitable chelating agents include for examples phosphonate chelating agents, polyfunctionally-substituted aromatic chelating agents, amino carboxylate chelating agents, other chelating agents like ethylene diamine N,N'- disuccinic acid and mixtures thereof.

Typically, the compositions herein may comprise up to 4%, preferably from 0.001% to 1%, and more preferably from 0.001% to 0.5% by weight of the total composition of a chelating agent.

Suitable phosphonate chelating agents to be used herein may include ethydronic acid, alkali metal ethane 1-hydroxy diphosphonates as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates (DETPMP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer, have been extensively described in U.S. Pat. No. 4,704,233, Nov. 3, 1987. to Hartman and Perkins. Ethylenediamine N,N'-disuccinic acid is, for instance, commercially available under the tradename ssEDDS® from Palmer Research Laboratories.

Suitable amino carboxylate chelating agents to be used herein include ethylene diamine tetra acetates, diethylene triamine pentaacetates, diethylene triamine pentaacetate (DTPA), N-hydroxyethylethylenediamine triacetates, nitrilotri-acetates, ethylenediamine tetrapropionates, triethylenetetraaminehexa-acetates, ethanoldiglycines, propylene diamine tetracetic acid (PDTA) and methyl glycine di-acetic acid (MGDA), both in their acid form, or in their alkali metal, ammonium, and substituted ammonium salt forms. A particularly suitable amino carboxylate to be used herein is diethylene triamine penta acetic acid (DTPA).

Other suitable chelating agents to be used herein include salicylic acid or derivatives thereof, or mixtures thereof according to the following formula:

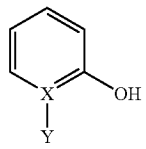

wherein X is carbon, Y is one of the following groups —CHO, —OH, —(CH2)n—COOH, and preferably is —(CH2)n—COOH, and wherein n is an integer of from 0 to 20, preferably of from 0 to 10 and more preferably is 0. Salicylic acid and derivatives thereof may be used herein either in their acid form or in their salts form as for example sodium salts.

Salicylic acid is particularly preferred herein and may be commercially available from Rhone Poulenc.

Radical Scavengers

The compositions herein may comprise a radical scavenger as another optional ingredient. Suitable radical scavengers for use herein include the well-known substituted mono and di hydroxy benzenes and derivatives thereof, alkyl- and aryl carboxylates and mixtures thereof. Preferred radical scavengers for use herein include trimethoxy benzoic acid (TMBA), di-tert-butyl hydroxy toluene (BHT), p-hydroxytoluene, hydroquinone (HQ), di-tert-butyl hydroquinone (DTBHQ), mono-tert-butyl hydroquinone (MTBHQ), tert-butyl-hydroxy anysole (BHA), p-hydroxy-anysol, benzoic acid, 2,5-dihydroxy benzoic acid, 2,5-dihydroxyterephtalic acid, toluic acid, catechol, t-butyl catechol, 4-allyl-catechol, 4-acetyl catechol, 2-methoxy-phenol, 2-ethoxy-phenol, 2-methoxy-4-(2-propenyl)phenol, 3,4-dihydroxy benzaldehyde, 2,3-dihydroxy benzaldehyde, benzylamine, 1,1,3-tris(2-methyl-4-hydroxy-5-t-butylphenyl) butane, tert-butyl-hydroxy-anyline, p-hydroxy anyline as well as n-propyl-gallate. Highly preferred for use herein is di-tert-butyl hydroxy toluene, which is for example commercially available from SHELL under the trade name IONOL CP® and/or tert-butyl-hydroxy anysole and/or propyl gallate. These radical scavengers further contribute to the stability of the compositions herein.

Typically, the compositions according to the present invention may comprise up to 5%, preferably from 0.002% to 1.5% by weight and more preferably from 0.002% to 0.5% by weight of the total composition of a radical scavenger.

Anti-Resoiling Agent

The compositions as disclosed herein may comprise as a preferred optional ingredient an anti-resoiling agent.

Suitable anti-resoiling agents include anti-resoiling polymers.

Suitable poly (vinyl methyl ether/maleic acid) copolymers are according to the general formula:

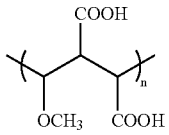

wherein n (degree of polymerisation) is an integer of from 50 to 1600, preferably from 100 to 800, and more preferably from 200 to 400.

Accordingly, suitable poly (vinyl methyl ether/maleic acid) copolymers for use herein have an average molecular weight of from 1'000 to 10'000'000, preferably 10'000 to 1'000'000, more preferably from 10'000 to 500'000, and most preferably from 50'000 to 100'000.

Suitable poly (vinyl methyl ether/maleic acid) copolymers are commercially available, for instance, from ISP Corporation, New York, N.Y. and Montreal, Canada under the product names Gantrez AN Copolymer® (AN-119 copolymer, average molecular weight of 20'000; AN-139 copolymer, average molecular weight of 41'000; AN-149 copolymer, average molecular weight of 50'000; AN-169 copolymer, average molecular weight of 67'000; AN-179 copolymer, average molecular weight of 80'000), Gantrez S® (Gantrez S97®, average molecular weight of 70'000), and Gantrez ES® (ES-225, ES-335, ES-425, ES-435), Gantrez V® (V-215, V-225, V-425).

Preferably the poly (vinyl methyl ether/maleic acid) copolymers are either crosslinked or not crosslinked, i.e., linear. More preferably the poly (vinyl methyl ether/maleic acid) copolymers are not crosslinked.

Suitable anti-resoiling polymers include soil suspending polyamine polymers. Any soil suspending polyamine polymer known to those skilled in the art may also be used herein. Particularly suitable polyamine polymers for use herein are alkoxylated polyamines. Such materials can conveniently be represented as molecules of the empirical structures with repeating units:

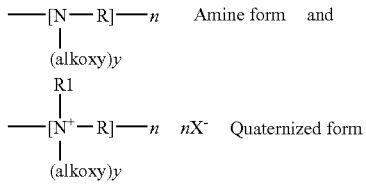

wherein R is a hydrocarbyl group, usually of 2–6 carbon atoms; $R_1$ may be a $C_1$–$C_{20}$ hydrocarbon; the alkoxy groups are ethoxy, propoxy, and the like, and y is from 2 to 30, most preferably from 7 to 20; n is an integer of at least 2, preferably from 2 to 40, most preferably from 2 to 5; and X- is an anion such as halide or methylsulfate, resulting from the quaternization reaction.

The most highly preferred polyamines for use herein are the so-called ethoxylated polyethylene amines, i.e., the polymerized reaction product of ethylene oxide with ethyleneimine, having the general formula:

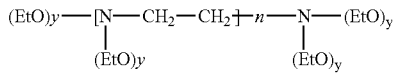

wherein y is from 2 to 50, preferably from 5 to 30, and n is from 1 to 40, preferably from 2 to 40. Particularly preferred for use herein is an ethoxylated polyethylene amine, in particular an ethoxylated polyethylene amine wherein n=2 and y=20, and an ethoxylated polyethylene amine wherein n=40 and y=7.

Suitable ethoxylated polyethylene amines are commercially available from Nippon Shokubai CO., LTD under the product names ESP-0620A® (ethoxylated polyethylene amine wherein n=2 and y=20) or from BASF under the product names ES-8165 and from BASF under the product name LUTENSIT K-187/50® (ethoxylated polyethylene amine wherein n=40 and y=7).

Suitable anti-resoiling polymers also include polyamine N-oxide polymers.

Suitable polyamine N-oxide polymers for use herein are according to the following formula: R-$A_x$-P; containing at least one N-oxide group (N—O group);

wherein: P is a polymerizable unit to which an N—O group can be attached and/or the N—O group can form part of the polymerizable unit;

A is one of the following structures:

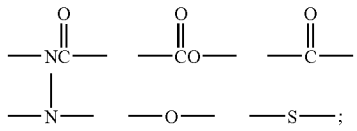

x is 0 or 1;

and R is an aliphatic, ethoxylated aliphatic, aromatic, heterocyclic or alicyclic group or any combination thereof to which the N—O group can be attached to R or the nitrogen of the N—O group is part of R.

By "N—O group" it is meant one of the following general structures:

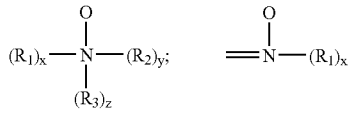

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups.

Any polymerizable unit P can be used as long as the amine oxide polymer formed is water-soluble and provides the carpet treatment composition with carpet cleaning and/or carpet anti-resoiling benefits. Preferred polymerizable unit P are vinyl, alkylenes, esters, ethers, amides, imides, acrylates and mixtures thereof. A more preferred polymerizable unit P is vinyl.

Preferred polyamine N-oxide polymers are those wherein R is a heterocyclic group such as pyridine, pyrrole, imidazole, or a derivative thereof, to which the nitrogen of the N—O group can be attached or the N—O group is part of these groups. Most preferred polyamine N-oxide polymers are those wherein R is a pyridine.

The polyamine N-oxide polymer can be obtained in almost any degree of polymerization. Typically, the average molecular weight is within the range of 1,000 to 100,000; more preferred 5,000 to 100,000; most preferred 5,000 to 25,000.

Suitable polyamine N-oxide polymer are polyvinyl pyridine-N-oxide polymers wherein: the polymerizable unit P is vinyl; x=0; and R is pyridine.

Suitable poly vinyl pyridine-N-oxide polymers are commercially available from Hoechst under the trade name of Hoe S 4268®, and from Reilly Industries Inc. under the trade name of PVNO.

Furthermore, suitable anti-resoiling polymers include N-vinyl polymer.

Suitable N-vinyl polymers include polyvinyl pyrrolidone polymers, co-polymers of N-vinylpyrrolidone and N-vinylimidazole, co-polymers of N-vinylpyrrolidone and acrylic acid, and mixtures thereof.

Suitable co-polymers of N-vinylpyrrolidone and N-vinylimidazole polymers (referred to as a class as "PVPVI") are according to the formula:

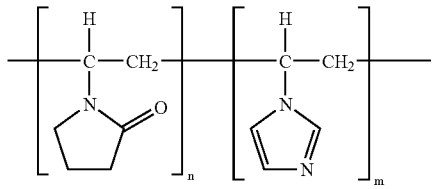

in which n is between 50 and 500 and preferably between 80 and 200 and m is between 50 and 500 and preferably between 80 and 200.

Preferably the PVPVI has an average molecular weight range from 1,000 to 100,000, more preferably from 5,000 to 100,000, and most preferably from 5,000 to 20,000. (The average molecular weight range is determined by light scattering as described in Barth, et al., *Chemical Analysis*, Vol 113. "Modern Methods of Polymer Characterization", the disclosures of which are incorporated herein by reference.)

The PVPVI co-polymers typically have a molar ratio of N-vinylimidazole to N-vinylpyrrolidone from 1:1 to 0.2:1, more preferably from 0.8:1 to 0.3:1, most preferably from 0.6:1 to 0.4:1. These co-polymers can be either linear or branched.

Suitable co-polymers of N-vinylpyrrolidone and N-vinylimidazole are commercially available from BASF, under the trade name of Sokalan® PG55.

Suitable polyvinylpyrrolidone ("PVP") for use herein are homopolymers of N-vinylpyrrolidone having the following repeating monomer:

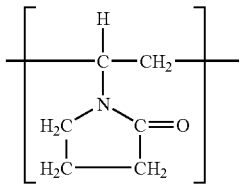

Preferred vinylpyrrolidone homopolymers for use herein have an average molecular weight of from 1,000 to 100,000, preferably from 5,000 to 100,000, and more preferably from 5,000 to 20,000.

Suitable vinylpyrrolidone homopolymers are commercially available from BASF under the trade names Luviskol® K15 (viscosity molecular weight of 10,000), Luviskol® K25 (viscosity molecular weight of 24,000), Luviskol® K30 (viscosity molecular weight of 40,000), and other vinylpyrrolidone homopolymers known to persons skilled in the detergent field (see for example EP-A-262,897 and EP-A-256,696).

Suitable co-polymers of N-vinylpyrrolidone and acrylic acid (referred to as a class as "PV/AA") are according to the formula:

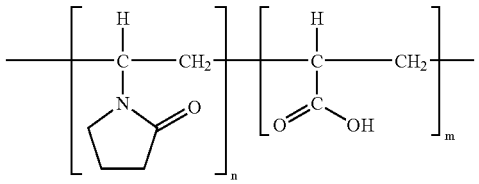

in which n is between 50 and 1000 and preferably between 100 and 200 and m is between 150 and 3000 and preferably between 300 and 600.

Preferably the PV/AA have an average molecular weight range from 1,000 to 100,000, more preferably from 5,000 to 100,000, and most preferably from 5,000 to 25,000.

Suitable co-polymers of N-vinylpyrrolidone and acrylic acid are commercially available from BASF under the trade name Sokalan® PG 310.

Preferred N-vinyl polymers are polyvinyl pyrrolidone polymers, co-polymers of N-vinylpyrrolidone and N-vinylimidazole, co-polymers of N-vinylpyrrolidone and acrylic acid, and mixtures thereof, even more preferred are polyvinyl pyrrolidone polymers.

Suitable anti-resoiling polymers also include soil suspending polycarboxylate polymers.

Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than 40% by weight.

Particularly suitable polymeric polycarboxylates to be used herein can be derived from acrylic acid, including polyacrylic polymers and copolymers of acrylic acid. Most preferred anti-resoiling polymers are copolymer of acrylic acid and methacrylic acid. Such acrylic acid-based polymers, which are useful herein, are the water-soluble salts of polymerized acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials, which are described in European Patent Application No. 66915, published Dec. 15, 1982. Particularly preferred is a copolymer of maleic/acrylic acid with an average molecular weight of 70,000. Such copolymers are commercially available from BASF under the trade name SOKALAN® C.P5.

Other suitable anti-resoiling polymers include those anti-resoiling polymers having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Anti-resoiling polymers useful in the present invention also include cellulosic derivatives such as hydroxyether cellulosic polymers, co-polymeric blocks of ethylene terephthalate or propylene terephthalate with polyethylene oxide or polypropylene oxide terephthalate, and the like. Such anti-resoiling polymers are commercially available and include hydroxyethers of cellulose such as METHOCEL® (Dow). Cellulosic anti-resoiling polymers for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Anti-resoiling polymers characterised by poly(vinyl ester) hydrophobe segments include graft co-polymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available anti-resoiling polymers of this kind include the SOKALAN® type of material, e.g., SOKALAN HP-22®, available from BASF.

One type of preferred anti-resoiling polymers is a co-polymer having random blocks of ethylene terephthalate and polyethylene oxide (PEO) terephthalate. The molecular weight of this anti-resoiling polymer is in the range of from about 25,000 to about 55,000. See U.S. Pat. No. 3,959,230 to Hays, issued May 25, 1976 and U.S. Pat. No. 3,893,929 to Basadur issued Jul. 8, 1975.

Another preferred anti-resoiling polymers is a polyester with repeat units of ethylene terephthalate units which contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126® (from Dupont) and MILEASE T® (from ICI). See also U.S. Pat. No. 4,702,857, issued Oct. 27, 1987 to Gosselink.

Another preferred anti-resoiling polymers agent is a sulfonated product of a substantially linear ester oligomer comprised of an oligomeric ester backbone of terephthaloyl and oxyalkyleneoxy repeat units and terminal moieties covalently attached to the backbone. These anti-resoiling polymers are fully described in U.S. Pat. No. 4,968,451, issued Nov. 6, 1990 to J. J. Scheibel and E. P. Gosselink. Other suitable anti-resoiling polymers include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred anti-resoiling polymers also include the soil release agents of U.S. Pat. No. 4,877,896, issued Oct. 31, 1989 to Maldonado et al, which discloses anionic, especially sulfoaroyl, end-capped terephthalate esters.

Still another preferred anti-resoiling agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred anti-resoiling agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said anti-resoiling agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807, issued May 16, 1995, to Gosselink et al.

The liquid compositions may comprise from 0.01% to 10%, preferably from 0.01% to 5%, and more preferably from 0.05% to 2% by weight of the total composition of a further anti-resoiling agent.

A preferred anti-resoiling agent is an anti-resoiling polymer. A more preferred anti-resoiling agent is a poly (vinyl methyl ether/maleic acid) copolymer, a soil suspending polyamine polymer, a poly vinyl pyridine-N-oxide polymer or a mixture thereof. An even more preferred anti-resoiling agent is a poly (vinyl methyl ether/maleic acid) copolymer, an alkoxylated polyamine polymer, a poly vinyl pyridine-N-oxide polymer or a mixture thereof. The most preferred anti-resoiling agent useful in the compositions herein are selected from the group consisting of: a poly (vinyl methyl ether/maleic acid) copolymer; an ethoxylated polyethylene amine according to the formula as described above wherein n=2 and y=20; an ethoxylated polyethylene amine according to the formula as described herein wherein n=40 and y=7; a poly vinyl pyridine-N-oxide polymer; and mixtures thereof.

Silica

In a preferred embodiment, wherein the composition comprising a pre-swollen absorbent gelling material herein is a solid composition, said composition may further comprise silica.

Suitable, silica are commercially available from Degussa under the trade-names Ultrasil® and Sipernat®.

Preferably, the composition comprising a pre-swollen absorbent gelling material herein may comprise up to 50%, more preferably from 0.1% to 40%, even more preferably from 0.5% to 10%, by weight of the total composition of a silica.

Cellulose

In a preferred embodiment, wherein the composition comprising a pre-swollen absorbent gelling material herein is a solid composition, said composition may further comprise a microcrystalline cellulose and/or a cellulose or a derivative thereof.

Suitable celluloses are commercially available under the trade name Arbocel®, commercially available from Rettenmaier and Nymcel® available from Metsa-serla. Suitable microcrystalline celluloses are available under the trade name Vivapur® from Rettenmaier.

Preferably, the composition comprising a pre-swollen absorbent gelling material herein may comprise up to 90%, more preferably from 1% to 60%, even more preferably from 3% to 50%, by weight of the total composition of a microcrystalline cellulose and/or a cellulose or a derivative thereof.

Other Optional Ingredients

The compositions herein may further comprise conventional carpet treating ingredients. Preferably, the compositions herein may further comprise a number of additional compounds such as stabilising agents, builder systems, radical scavengers, perfumes, dyes, suds suppressing agents, photobleaching agents, and other minors.

EXAMPLES

The following examples will further illustrate the present invention. The compositions are made by combining the listed ingredients in the listed proportions (weight % unless otherwise specified). The following Examples are meant to exemplify compositions used in a process according to the present invention but are not necessarily used to limit or otherwise define the scope of the present invention.

Examples

| Compositions (weight %) | |
|---|---|
| I | II |
| Molecular Sieve UOP 13X ® (45%) | Molecular Sieve UOP 4A ® (35%) |
| $NaHCO_3$ (45%) | $Na_2CO_3$ (20%) |
| n-BP (8%) | Arbocel B800 ® (35%) |
| AGM (40%) | AGM (25%) |
| Perfume (2%) | Hexyl Cellosolve (10%) |
| III | IV |
| Molecular Sieve UOP 3A ® (35%) | Molecular Sieve UOP 13X ® (30%) |
| Arbocel B800 ® (35%) | Arbocel B800 ® (35%) |
| Hexyl Cellosolve (10%) | Ultrasil UN3SP ® (10%) |
| Ultrasil UN3SP ® (10%) | AGM (15%) |
| AGM (10%) | Hexyl Cellosolve (10%) |

AGM is a crosslinked polyacrylate supplied by Shokubai.
Molecular Sieve UOP 13X®, 4A and 3A are activated zeolites supplied by UOP.
$NaHCO_3$ and $Na_2CO_3$ are supplied by Solvay.
n-BP is n-butoxy propanol supplied by Union Carbide.
Hexyl Cellosolve is a solvent supplied by Union Carbide.
Ultrasil UN3SP® is 20 micron silica supplied by Degussa.
Arbocel B800® is a cellulose supplied by Rettenmaier.

What is claimed is:

1. A process of treating a fabric comprising contacting the fabric with a composition comprising:

a) a pre-swollen absorbent gelling material having a water content of less than 5%, said absorbent gelling material being water-insoluble, water-swellable, and capable of forming a gel when said absorbent gelling material is contacted by moisture;

b) an activated zeolite;

c) a component selected from the group consisting of silica, microcrystalline cellulose, cellulose, or a derivative thereof.

2. A process according to claim 1 wherein said composition is a solid composition.

3. A process according to claim 1 wherein said composition comprises up to 80% by weight of a pre-swollen absorbent gelling material.

4. A process according to claim 1 wherein said pre-swollen absorbent gelling material is a pre-swollen absorbent gelling polymer.

5. A process according to claim 4 wherein said absorbent gelling polymer herein is selected from the group consisting of cross-linked polycarboxylates and mixtures thereof.

6. A process according to claim 1 wherein said composition is applied on said fabric and optionally left to act on said fabric and/or removed from said fabric.

7. A process according to claim 1 wherein said fabric is a carpet or a hard wearing textile or fabric.

8. A process according to claim 1 wherein said composition additionally comprises a solvent.

9. A process according to claim 1 wherein said process comprises the steps of applying, in any order, to said fabric said composition and a second composition.

10. A process according to claim 9 wherein said second composition is a liquid or solid carpet treatment composition or comprises ingredients selected from the group consisting of: water; polar solvents; and mixtures thereof.

11. A kit for treating a fabric comprising:

1. a composition comprising;
   a) a pre-swollen absorbent gelling material having a water content of less than 5%, said absorbent gelling material being water-insoluble, water-swellable, and capable of forming a gel when said absorbent gelling material is contacted by moisture;
   b) an activated zeolite;
   c) a component selected from the group consisting of silica, microcrystalline cellulose, cellulose, or a derivative thereof.
2. a fabric cleaning composition or water.

12. A kit for treating a fabric comprising:

1. a composition comprising;
   a) a pre-swollen absorbent gelling material having a water content of less than 5%, said absorbent gelling material being water-insoluble, water-swellable, and capable of forming a gel when said absorbent gelling material is contacted by moisture;
   b) an activated zeolite;
   c) a component selected from the group consisting of silica, microcrystalline cellulose, cellulose, or a derivative thereof.
2. a set of instructions to use said composition in a process according to claim 1.

* * * * *